US005461780A

United States Patent [19]

Morana

[11] Patent Number: 5,461,780

[45] Date of Patent: Oct. 31, 1995

[54] HAIR TRIMMING DEVICE

[76] Inventor: Frank J. Morana, 41 Laurel Ave., West Orange, N.J. 07053

[21] Appl. No.: 100,498

[22] Filed: Jul. 30, 1993

[51] Int. Cl.[6] ..... B26B 21/12

[52] U.S. Cl. ..... 30/30; 30/29.5

[58] Field of Search ..... 30/29.5, 30, 31, 30/34.05, 195, 53; 411/152, 153, 155, 156, 409, 544; 132/148

[56] References Cited

U.S. PATENT DOCUMENTS

| | | | |
|---|---|---|---|
| 1,693,973 | 12/1928 | Alland | 30/30 |
| 1,878,549 | 9/1932 | Sireci | 30/30 |
| 2,201,930 | 5/1940 | Stark | 411/153 |
| 2,256,326 | 9/1941 | Quinio | 30/30 |
| 3,183,589 | 5/1965 | Szabo | 30/32 |
| 3,699,653 | 10/1972 | Miller | 30/32 |

FOREIGN PATENT DOCUMENTS

| | | | |
|---|---|---|---|
| 129562 | 7/1919 | United Kingdom | 30/30 |

*Primary Examiner*—Hwei Siu Payer
*Attorney, Agent, or Firm*—Mark L. Hopkins

[57] ABSTRACT

A simple, purely mechanical, hand-held yet handleless, do-it-yourself hair trimming device employing conventional razor blades and operable by a typical combing motion. The blades are sandwiched between a base element and a mating backing element, both of which have one or more arrays of comb-like teeth and the backing element may be a comb per se. The base and back elements are disengagably adjustably secured together by a spring-loaded thumb screw/cup nut configuration which allows ease of blade replacement and versatility through user selection from multiple tooth array/blade edge combinations, intended to maximize the efficiency of the cut with regard to the various different areas of the head.

21 Claims, 3 Drawing Sheets

100
105
20

20
28
29
21
12
28
12
21
70a
70b 100
150
106
150
107b
107a
106
105

20
100
13
14
8
8
12
107b
13
14
12
105

HAIR TRIMMING DEVICE

BACKGROUND OF THE INVENTION

This invention relates to simple and inexpensive hand-held, non-motorized, i.e., purely mechanical, do-it-yourself hair trimming or cutting devices, and more particularly to handleless hair trimming/cutting devices, utilizing conventional razor blades safely deployed therein, and operable by a typical combing action.

Relatively simple purely mechanical or non-motorized hair trimming devices which are operable via a regular hair combing action are known to the art. Such a device is found in U.S. Pat. No. 4,441,252, which describes a hair trimming device using conventional double-edged razor blades sandwiched between a base plate and mating capping member, both of which are provided with a pair of oppositely arranged, groups of comb-like teeth of the same configuration. The blade-sandwich unit is removably mountable to the forked distal end of a handle. The forked end has resilient arms which allow the sandwich to be slidably inserted therein to a force-fit locked position.

Such a device, while being simple offers the user no versatility as to operative or combing/cutting interfaces or surfaces for the various different parts of the head, and is clumsy with regard to blade replacement and provides no adjustment factor to counter aging (wear and tear) or user "feel".

Another mechanical/non-motorized hair cutting device, significantly more complex than the foregoing device, is found in U.S. Pat. No. 3,986,258. This arrangement provides a blade interchangeably retained between a blade-support plate and a cover plate, which has a row of teeth of linearly varying length overlapping the blade cutting edge. The two plates are displacable perpendicularly to the cutting edge and relative to each other between a pair of end positions. The device provides a wedge-shaped element proximate the blade cutting edge which increases in thickness extending from the cutting edge to enable the blade to be effectively adjustable to a cutting angle determined by the front ends of the comb-like teeth together with contact of the wedge with the head. A coupling member is disposed on each plate to selectively locate same relative to one another and a spring retains the coupling members, with prestressing, in positive engagement with one another.

In both of the foregoing arrangements, only one configuration of fixed comb-like teeth is provided. In the case of the "258" patent device, the configuration consists of a single row of teeth of consistent tooth spacing, only the length parameter of which teeth varies (in the given case, linearly) from a minimum at the forward operative end to a maximum at the other end of the operative surface, whereby the free ends of the teeth define a line of points which forms an acute angle with the longitudinal axis of the main body and handle of the device. Additionally, blade replacement is a relatively complicated process.

The device of the "252" patent provides a single configuration of teeth consisting of a pair of oppositely arranged rows, the spacing and length of which teeth are consistent, such that the ends of the teeth of each row define the same line of points parallel to and separated the same distance from, though on opposite sides of the longitudinal axis of the body and handle of the device.

SUMMARY OF THE INVENTION

Among the things the above-described prior art devices fail to provide is a simple, inexpensive, yet highly versatile, purely mechanical or non-motorized arrangement which is capable of cutting the hair neatly as desired with regard to each of the different areas of the head, such as the sides, back, neck, top and front, as well as the side burns, and yet be of such limited size as to easily fit into one's pocket or otherwise be of convenient travel size and allow easy, quick blade replacement, and such constitutes a principal objective of the within invention. As is more particularly described hereinafter, this objective is accomplished through providing a relatively long length of cutting edge safely provided in a lightweight, slender enclosure, enabling the user to cut, trim or smooth a complete segment of hair with each stroke, taking into consideration the generally circular path required by the shape of the head. The invention makes possible the ability to exchange the cutting edges quickly and easily, and yet have a sure guide to cut at the desired point at all the different parts of the head with anticipated visibility (or possible lack thereof, in the case of the back of the head). The device according to the invention is mechanically suitable for the inexperienced, and yet provides great versatility though it is inexpensive and easy to fabricate.

According to the invention, there is provided a handleless hair trimming/cutting device, which comprises an elongated base element defining a first longitudinal axis and a first facing surface of predetermined configuration; a backing element at least a portion of which is elongated comparably to at least a portion of the base element, and defining a second longitudinal axis substantially coincident in direction with the longitudinal axis of the base element and a second facing surface of predetermined configuration intended for mating relationship with said first facing surface; at least one of said base and back elements providing at least one set of comb-like teeth of predetermined length and spacing (which may be equal length or alternating in different lengths), arranged relative to its longitudinal axis; at least one of said base and back elements providing an elongated recess extending longitudinally for safely housing one or more conventional razor blades; orientation-adjustable locking means operatively coupled to one of said base or backing elements, for disengagingly adjustably locking the base and back elements together; and at least one aperture of predetermined configuration extending through the other of said base or back, for receiving at least a portion of said locking means when the latter is in a first position and securing the base and back elements together, with the razor blades therebetween, when in a second position; the ultimate in simplicity, safety, versatility and ease of use and yet most inexpensive.

Unlike the above prior art, the securing means of the inventive arrangement allows the repository of the blades to be readily reconfigured to another position and/or operative hair trimming surface. More particularly, this invention provides a self-contained, purely mechanical device capable of providing multiple sets of simultaneously available, differently configured teeth, to offer the user diverse operative "surfaces" devised for use in connection with the different parts of the head. Hair trimming at the desired length is effected simply by combing the hair. This is accomplished through providing a handleless device having two or more operative surfaces each providing at least one set of comb-like teeth of differing arrangement or configuration. The teeth may vary by any or all of their spacing, length and/or cross-sectional dimension parameters, as well as the width and depth of the spaces between the teeth. The element providing the sets of teeth itself may be substituted by similarly structured elements, the set or sets of teeth of which may differ from the sets of teeth of the substituted element in any or all of the aforesaid parameters, as well as in the actual number of sets of teeth per se.

In its most fundamental embodiment, the inventive device is a handleless arrangement comprised of an elongated base and an equivalently elongated backing member safely securing stationarily therebetween, in a broad recess defined between, or within one of, said elements, at least one conventional double-edged razor blade. One of the base and back members provides a pair of sets of oppositely arranged, dissimilarly disposed, comb-like teeth, which sets may be dissimilar in length, spacing and/or cross-sectional diameter of the teeth as well as the width and depth of the spaces between the teeth.

Within the set itself, the teeth may vary by length, such as linearly so as to have the tips thereof define a line of points forming an acute angle with respect to the longitudinal axis of the base. Alternatively, the teeth may vary in length non-linearly, whereby the tips form, for example, a concave arc of predetermined radius, the radius defined thereby being either perpendicular to the aforesaid longitudinal axis or forming an acute angle with the perpendicular.

The base and back members are secured together by at least one simple thumb screw/nut combination, preferably a pair, wherein the thumb screw extends through cooperatively aligned holes through the base and back elements, one of which holes is elongated to accommodate the passage therethrough of the flattened control or turning end of the thumb screw, to allow separation of the base and back for blade replacement purposes without disengaging the thumb screw from its nut, and thus without separation of the screw/nut combination from its host element. The turning end of the thumb screw is shaped such that in the one orientation whereby the turning end aligns with the longitudinally running slot in the razor blades, the blades can slip over the turning end in the blade replacement process.

The nut is preferably a cup nut which can accommodate an annular recess to partially house a spring centered on the threaded shaft portion of the thumb screw to allow spring-loading beneficial adjustment to the orientation of the turning end of the thumb screw and to the adjustment of the screw/nut combination per se. This effectively corresponds to providing the user with adjustability, as desired, of the spring tension urging the base and back elements in contact with each other.

Complete safety from the danger of the sharp blade edges is provided by the fact that the actual blade edges are exposed only between the teeth, thereby assuring that nothing as large or larger in cross-section than the spacing between the teeth may come in contact with the sharp edges of the razor blades. Complete safety is assured even when changing configurations or blades. The blades themselves are maintained in place by ribs arranged on the facing surface of one of the base or back elements. The ribs are positioned to extend through the longitudinally centered holes as slots provided in the conventional blades, not unlike the conventional razor and preferably proximate the extremities of such apertures. The other of the base and back members provides one or more slotted recesses to accommodate the ribs extending from the base through the blades, thereby effectively locking the blades in position when the base and back are assembled together.

The inventive device is particularly well suited for travel by virtue of its small size and handleless configuration, as well as the safety protection from direct access to the blade edges.

BRIEF DESCRIPTION OF THE DRAWINGS

The above-mentioned and other features and advantages, and the invention itself, will become more apparent and better understood with reference to the following detailed description, taken in conjunction with the accompanying drawings, in which.

DETAILED DESCRIPTION

Figure 1:
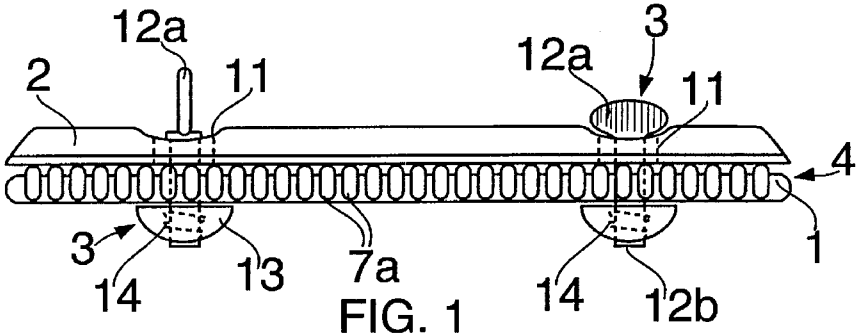
FIG. 1 is a diagrammatic edge view of the most fundamental embodiment of the invention, illustrating the base and backing elements assembled together.

FIG. 1 depicts in the assembled state the most fundamental embodiment of the invention, comprising a handleless base element 1 and a handleless backing element 2, secured together by a pair of thumb screw/cup nut combinations 3. Sandwiched between the base and back elements are a plurality of conventional razor blades 4, in this case three in number (FIG. 2A.).

Figure 4:
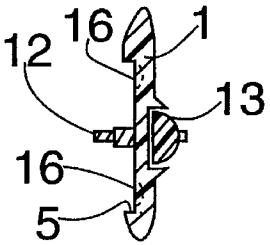
FIG. 4 is a diagrammatic cross-sectional end view of the base element of FIG. 2A, taken along the line 4—4, with the razor blades removed.
Figure 2B:
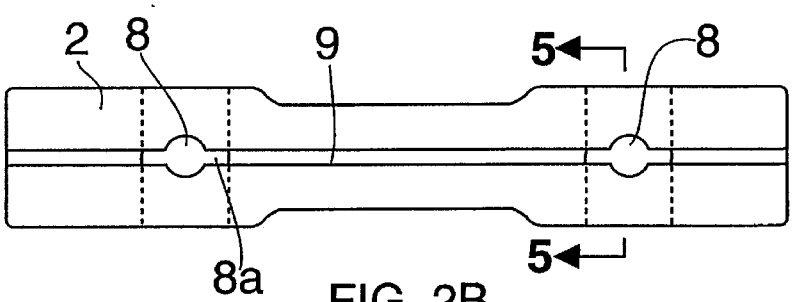
FIGS. 2A and 2B are respectively diagrammatic views of the facing surfaces of the base and backing elements of FIG. 1, with FIG. 2A showing the razor blades retained in place.
Figure 2A:
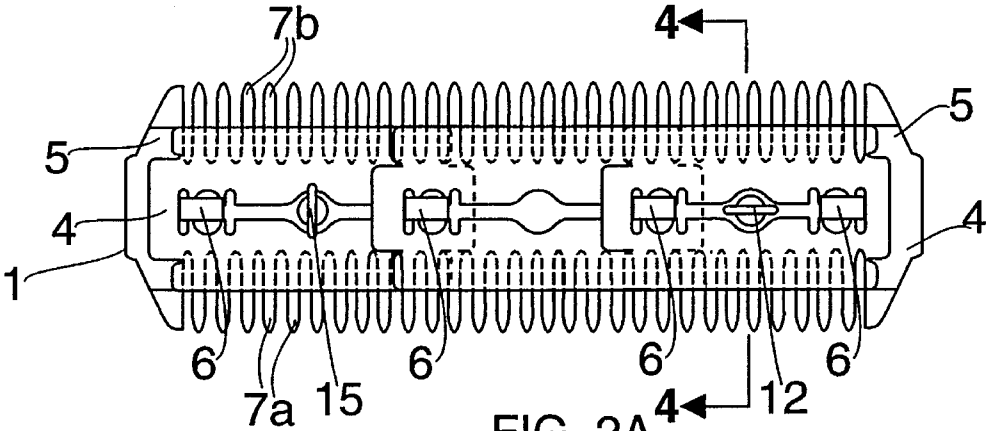

As particularly seen. in FIG. 2A, which diagrammatically illustrates the broad substantially flat surface of the base element 1 that faces and mates with the back element 2, as well as in FIG. 4, which is a cross-sectional view of the base element of FIG. 2A, taken along the line 4—4, base element 1 is a unitary piece of substantially rigid, yet light-weight, material, preferably plastic, having two sets of comb-like teeth 7*a* and 7*b*, and a recess 5 extending along the longitudinal axis of the base 1 from end to end to safely house the razor blades 4. Recess 5 is of sufficient depth to accommodate a series of overlapping blades, as is more particularly shown in FIG. 4. Along the longitudinal axis of the base element 1 are arranged a plurality of ribs 6 sufficiently spaced apart to receive the razor blades and secure same in position when the hair trimming device is assembled.

Figure 5:
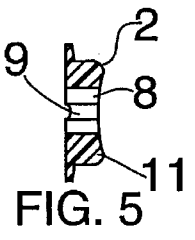
FIG. 5 is a diagrammatic cross-sectional end view of the back element of FIG. 2B, taken along the line 5—5.

FIGS. 2B and 5 diagrammatically illustrate, respectively, the broad flat surface of the backing element 2 which faces and mates with the base element 1, and a cross-sectional view of the back element 2 of FIG. 2B, taken along the line 5—5. Like base element 1, backing element 2 is a unitary piece preferably made of substantially rigid light-weight plastic material. It is provided with a groove 9 extending along its longitudinal axis which is intended to accommodate and mate with the ribs 6 of base element when the hair trimming device is fully assembled.

In FIGS. 2B and 5, the back element 2 is shown with a pair of elongated or slotted holes 8, each extending through it from the mating or internal broad surface to the external surface. The holes 8 are located on and elongate in the direction of the longitudinal axis of the back element 2, and have a central widened area to readily accommodate the securing means.

Figure 3:
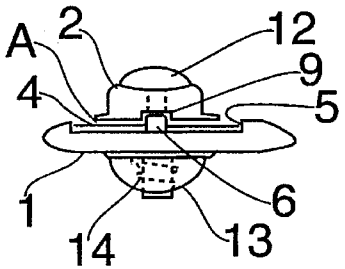
FIG. 3 is a diagrammatic end view of the right end of FIG. 1, with however, the head of the right side thumb screw rotated ninety degrees for clarification.

FIG. 3 illustrates in end view the fully assembled device of FIG. 1, providing the razor blades 4 safely secured in place between the base element 1 and backing element 2, in the recess 5 provided, in this case in the base element 1. Alignment longitudinally is established by the ribs 6 mating with the elongated recess 9 which extends along the longitudinal axis the backing element 2. In its assembled state, the base and backing elements of the device are secured in place via the spring-loaded thumb screw and locking nut arrangement more particularly shown in FIG. 6. In each case of possible arrangement between the base element 1 and backing element 2, including the combination illustrated in FIG. 3, there is provided an appropriate gap between the operative side edge of the backing element and the operative side edge of the blade recess (see gap "A" in FIG. 3 and "B" in FIG. 9B).

FIG. 4 shows the base element (and/or indeed the backing element) may be provided with secondary recesses 16 running longitudinally in the recess 5 proximate the sharp edges of the razor blades. It will be appreciated that, though not essential, these secondary recesses facilitate the removal of hair from the device.

Figure 6:
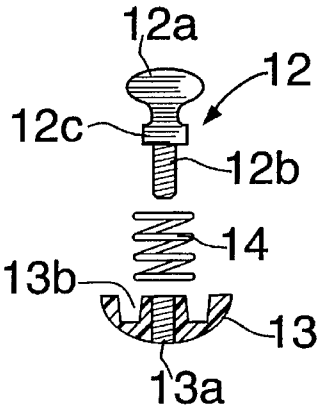
FIG. 6 is a diagrammatic exploded, partial cross-sectional view of the thumb screw/cup nut combination.

FIG. 6 diagrammatically illustrates a preferred version of the securing means, which comprises a thumb screw 12 and a mating cup "nut 13. The thumb screw is comprised of a shank which has a substantially centrally located first portion 12*c* of predetermined larger diameter with a stop and a threaded shaft portion 12*b* of predetermined smaller diameter, and a". flattened turning end 12*a* adapted to allow the threaded portion of the thumb screw to be rotated by hand, e.g., by the thumb and forefinger. The cup nut is provided with a central threaded hole 13*a* to accommodate the shaft portion of the thumb screw. Arranged on the shaft portion is a spring 14, which seats in an annular recess 13*b* provided in the cup nut 13 inter alia to aesthetically hide the spring from view and for a smooth ride over or through the hair. The thumb screw and cup nut are composed of any suitable rigid light-weight material, preferably metal for the thumb screw and plastic for the cup nut.

Initially, the securing means 12–14 are each separately arranged on the base element 1 by extending the shaft portion of the thumb screw 12 through a hole of substantially circular cross-section 15 in the base element 1, placing the spring 14 on the protruding threaded end, and rotating the turning end 12*a* to allow the threaded shaft portion to seat in the cup nut 13, to the point of a desirable spring tension. The circular holes 15 (FIG. 2A) are located on the longitudinal axis of the base 1 and spaced apart sufficiently to align with the central generally circular portion of the aperture of typical 2-edge razor blades 4 positioned at either end of the base element 1 and thereby allow the turning end of the thumb screws to appropriately accommodate the set of conventional razor blades. The arrangement of the securing means 12–14 on the base 1 is thus such that the turning end of the thumb screw is associated with the mating/facing surface of the base which provides recess 5 and ribs 6.

The spring loading provided by spring 14 keeps the turning end of the thumb screws in steady position when engaging or disengaging the base with/from the backing element and prevents undesirable play between the base and backing elements, and the thumb screw 12 and cup nut 13 of the securing means 3 will not disengage, no matter how many times the thumb screw is turned in any direction. Also, the securing means 3 will not turn at all unless the user desires that this occur due to the control maintained by the spring tension.

With the securing means 12–14 thusly mounted to the base, the turning end of each thumb screw should be oriented such that the broad surfaces of the flatten portion are substantially parallel to the longitudinal axis of the base 1. In such orientation the turning end of the thumb screws are able to receive the razor blades, allowing placement of same in the recess 5 and positionally stabilized by the ribs 6. This orientation of the turning end of the thumb screws also allows the back element 2 to slip onto the securing means, by having the turning end of the thumb screw pass through the appropriately elongated hole 8 in back element 2.

With the backing element 2 in position, the turning end of each of the thumb screws is then rotated preferably 90 degrees to safely secure the device together, with the razor blades in the recess 5 and the longitudinal axis of the base and back elements aligned and coincident. Back element 2 is provided with a pair of recesses 11 in its exterior broad surface, suitably shaped about the slotted holes 8 to allow the turning end of the thumb screw to be rotated in place to secure the device together.

Blade replacement is effected by simply rotating the turning end 12*a* of the thumb screws 12 so as to have the flat surfaces of said ends once again be parallel to the slots 8*a*, and correspondingly to the longitudinal axis of the base and back elements. In this orientation, the backing element 2 may be disengaged from the base element 1 by simply slipping same off the thumb screws, thus exposing the blades. The presence of the springs 14 assists in the engagement and separation of the base and backing elements.

Because the razor blades are housed in recess 5, the sharp edges of the blades 4 are only exposed between the comb-like teeth 7*a*, 7*b*. That is, the sharp blade edges are inaccessible to all things larger than the spacing between the comb-like teeth provided.

Through the design of the securing means 3, the thumb screw 12 and cup nut 13 are adjustable relative to one another. This attribute, together with the inclusion of the spring on the shaft portion 12*b* of the thumb screw, enables the user to vary the tension on the spring 14 and thus the force maintaining the base element and backing element in mating relationship, as desired. Adjustment of the spring tension is effected by holding the thumb screw portion with one hand and the cup nut with the other, and rotating the one piece relative to the other. Typically, this adjustment would be made at the factory, but remains available to the user, as appropriate, to personal choice.

Figures 8A, 8B, 8C, 8D:
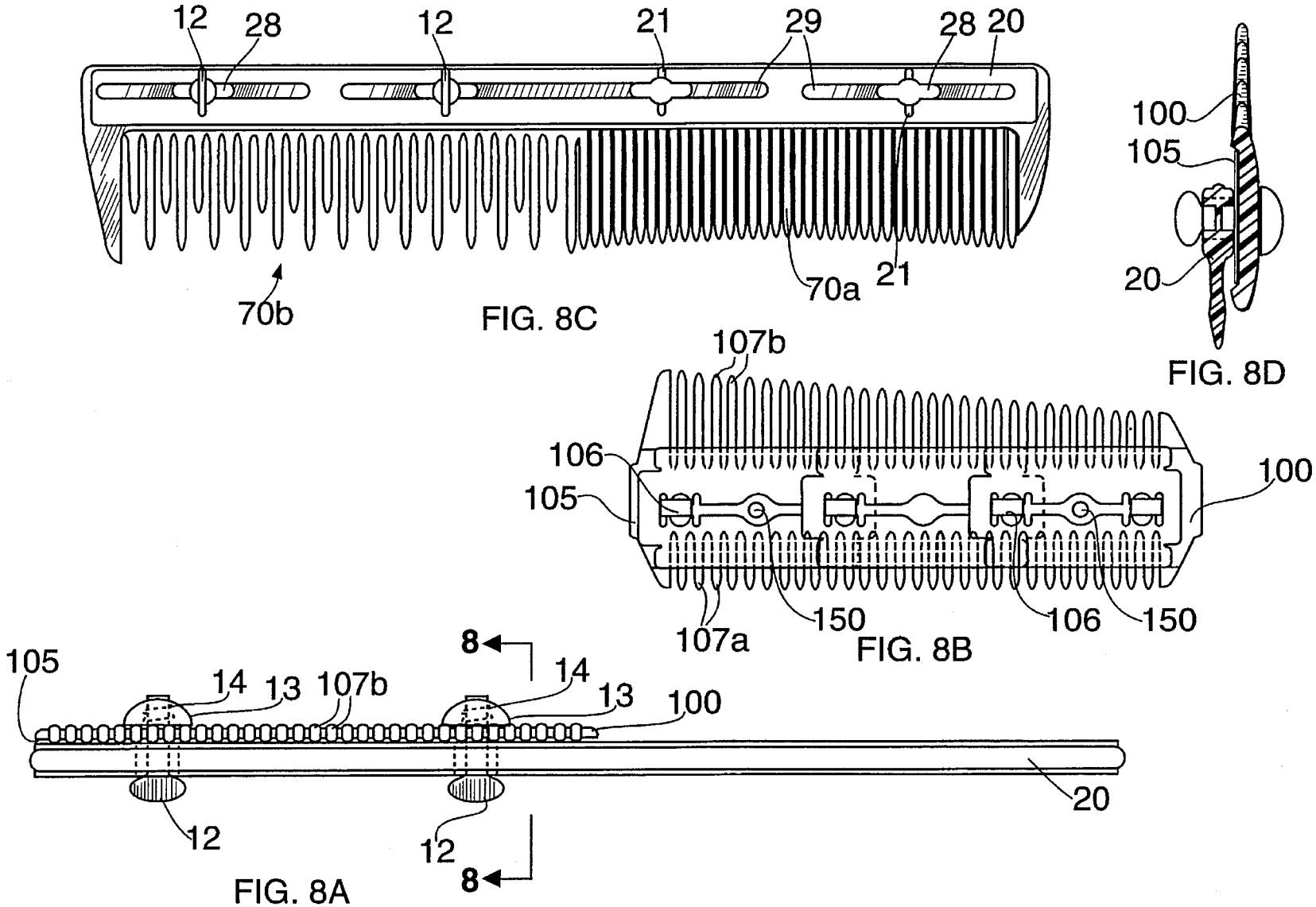
FIGS. 8A–8D are respectively diagrammatic edge, side and cross-sectional end views (the latter taken along line 8—8 of FIG. 8A) of a second embodiment according to the invention, in which the base element provides differing sets of teeth and the backing element is a regular comb, modified to accommodate the ribs of the base and passage therethrough of the thumb screw head(s)

FIGS. 8A–8D depict another embodiment of hair trimming device according to the invention, wherein a regular comb 20 is utilized as the backing element, modified to the extent of accommodating the thumb screw portion(s) of the securing means and the ribs of the base element 100. FIGS. 8A and 8D show the embodiment with the base element 100 assembled with the backing/comb element 20. In FIG. 8D, however, the head portion of the thumb screw 12 is shown rotated roughly ninety degrees for clarity.

As seen in FIG. 8C, the comb/backing element 20 provides two sets of differing teeth 70*a*, 70*b*. In the example depicted, the one set 70*a* comprises relatively fine teeth, i.e., the cross-sectional dimension of each of the teeth, as well as the separation between the teeth, is approximately the same and is relatively small. The ends of the teeth 70*a* vary in concave arcuate manner relative to the backing element's longitudinal axis, with a predetermined radius of arc. In this instance, the teeth more or less continuously vary in length on either side of a line perpendicular to said longitudinal axis which centrally bisects the set of teeth, such that the shortest teeth are located at the center area of the set and the longest at the far ends thereof.

The other set 70*b* is comprised of a coarse arrangement of teeth, i.e., the separation and/or cross-sectional dimension of the teeth are significantly larger than that attributed to a fine set of teeth. In the example shown, the course teeth 70*b* alternately vary in length between long teeth and shorter teeth, whereby the tips of the long teeth define a first line of points parallel to the backing element's axis, and the tips of the shorter teeth define a second line of points, also parallel to said axis but closer thereto.

Backing element/comb 20 has one or more slotted recesses 29 running parallel with its longitudinal axis to receive the ribs of the base element 100, in like manner to that depicted in FIGS. 1–5. Similarly, slotted holes 28 are provided in the recesses 29 to receive the turning end of the thumb screws 12. FIG. 8C shows two thumb screws associated with the comb 20, both in the secure position, that is, the orientation of the flat surfaces of the turning end of the thumb screws is such that the turning end is effectively perpendicular to the slotted hole 28. The base element otherwise associated with the securing means 12 is not particularly shown in FIG. 8C. Recesses 21, similar to recesses 11 of FIGS. 1 and 5, are provided to facilitate placement of the thumb screw head portion 12*a* into final locked position, In this embodiment, recesses 21 are narrow and perpendicularly arranged relative to their associated slot 28.

The base element 100 shown in FIG. 8B is without the securing means for clarity. As with the base element 1 of FIG. 2A, element 100 is provided with a recess 105 to receive the conventional razor blades, and a plurality of ribs 106 running along the longitudinal axis of the element to properly position and help secure the blades. Through the element 100 is a pair of holes 150 of substantially circular cross-section, to accommodate the shaft portion 12*b* of the thumb screw 12 of the securing means 3.

The sets of teeth 107*a*, 107*b* of base element 100 again differ from one another. In the example shown, however, the one set 107*a* provides coarse teeth, short in length, but with a consistent length throughout. The other set 107*b* is also a course set of teeth, but the length is continuously varying from a minimum at one end to a maximum at the other end, whereby the tips of the teeth define a set of points and an operative surface which is straight, that is, it varies linearly relative to the longitudinal axis of the base element 100.

The ribs shown in FIG. 8B comprise the appropriate minimal number and positioning to accommodate a set of three conventional 2-edge razor blade by protruding proximate the extremities of the blade slots to provide a long length of cutting edge securely yet safely in place in the recess 105.

At a minimum, therefore, the device of FIGS. 8A–8D is able to provide at any given time at least three different sets of comb-like teeth, two of which are operatively associated at any time with the razor blades. As such, the device operates both as a comb and a hair trimming device, both at the same time and also alternatively as to said functions. For example, the base element could be assembled with its razor blades to the right side portion of the backing element/comb 20, with the teeth 107*a* operatively arranged with the tooth set 70*a*. This effectively provides two different sets of teeth associated with the blades, i.e., set 107*b* and the combined set of 107*a* and 70*a*, for hair trimming purposes. By way of example, a shallow angle of cutting employed in connection with large long teeth would effectively provide a long cut. The tooth length is important, as is how far from the scalp one is passing the device through the hair. The device also provides tooth set 70*b* for solely hair combing purposes.

The user may wish to change the combination of operative surfaces/sets of teeth, and may do so by simply rotating the thumb screws 12 to align with the slots 28 of backing element 20 and remove the base element, with its securing means intact thereon, and then placing the base element back in mating engagement with the backing element 20, to provide the desired combination of operative surfaces, for example set 107*b* and the combination of sets 107*a* and 70*b* for the hair trimming function, and set 70*a* for the combing function.

Of particular note is the fact that, although not specifically shown in FIGS. 8A–8D, the recesses 29 preferably appear on both sides of the comb/backing 20, generally opposite one another. this provides the user with complete left hand-right hand choices. For example, it has been determined that in general, a superior, i.e., more efficient, cut is achieved when the base element is situate on the back side of the comb or back element, that is, the side of the comb/back element away from the scalp. With the recesses 29 appearing on either side of the backing element 20, one is able to assemble the device so that regardless of which side of the head the user wishes to trim, one is able to provide the base element to the away side of the backing element.

It will also be apparent that in the various arrangements of the base element 100 with the comb backing 20, there is provided an operative surface where only one set of teeth are available for use in the hair trimming mode, and a second operative surface wherein a combined grouping of two sets of teeth are provided in the hair trimming mode.

Along the spine or longitudinal axis of the comb backing, one may provide a slightly raised area or thickness to allow some separation or gap between the blades which are advantageously tightly held to the teeth of the base element, on the one hand, and the teeth provided by the comb on the other hand, so as to allow cutting of the hair freely and without pulling, and yet permit ease of cleaning hair from the device while still assembled. In this way, cleaning may be accomplished by a hair blower or by tapping the device on a firm surface.

Figure 9A:
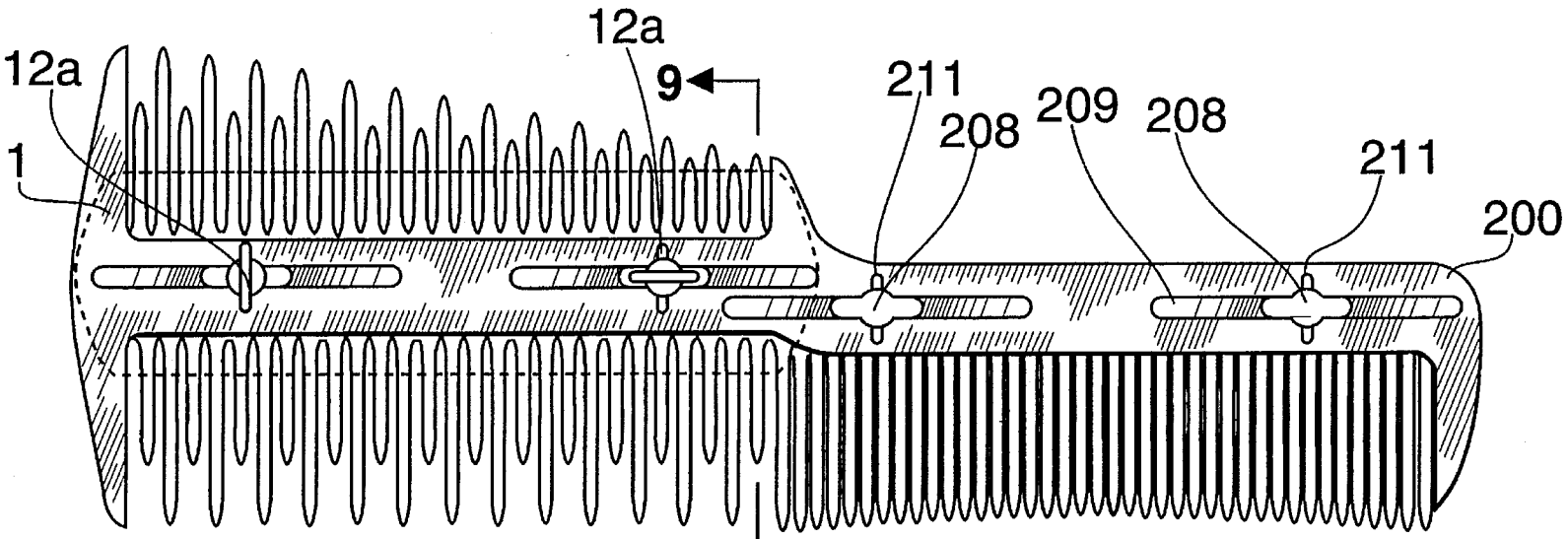
FIGS. 9A and 9B diagrammatically illustrate in respective side and cross-sectional end views (the latter taken along line 9—9 of FIG. 9A) another form of comb-like backing element, itself providing three different sets of teeth.
Figure 9B:
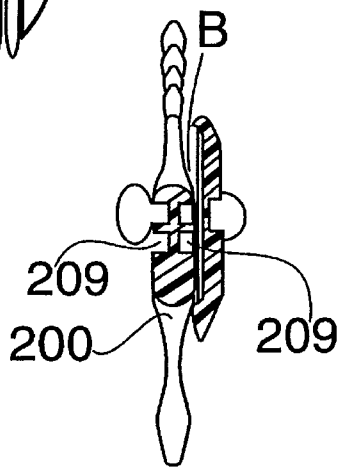
Figure 7:
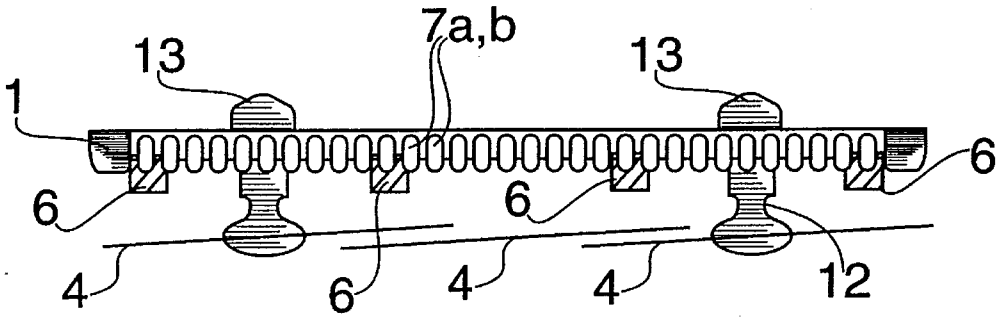
FIG. 7 is a diagrammatic edge view of the base element showing the arrangement of the razor blades being assembled on the base.

FIGS. 9A and 9B illustrate yet another embodiment according to the invention, wherein a backing element 200, again in the form of a comb, provides at least three differing sets of teeth and thus three different available operating surfaces, to be associated with the base element for progressive step usage (e.g., from longer to shorter cuts), where the longitudinal axis of each half of the backing element may be offset from one another (as is shown) to facilitate the ease of change in cut length. As shown, the base element 1 is in operative engagement with the backing element/comb 200, with the turning end 12*a* of one of the thumb screws 12 oriented to secure the arrangement intact, i,e., perpendicular to the longitudinal axes of the base and backing elements, and the other oriented in the blade-replacement mode. The thumb screws of base element 1 are received in the slotted holes 208 through backing element 200 arranged along the latter's axis.

As before, at least one elongated recess 209 is also provided in parallel with said axis to receive the ribs of the base element 1. Similarly, recesses 211 are provided in association with slots 208 to receive the thumb screw head 12*a* in its final, i.e., locking, position. Similar to backing element 20, backing element 200 is provided with recesses 209 on both faces, for right and left hand use.

When the base element, e.g., of FIG. 2A, is attached to the backing element of FIGS. 9A and 9B, and more particularly to the right side thereof, for example, with the shortened set of teeth pointing upward, this arrangement provides the user with a fourth operative surface, two of which surfaces are associated with hair trimming and two with a purely combing function. In all, the two sets of teeth of the base element and the three sets of teeth of the backing element provide the user with enhanced versatility through the various combinations these five sets of teeth offer.

As with the comb backing of FIG. 8C, the comb teeth essentially guide the hair properly to the blade. This avoids bunching and snarling, and missed (i.e., not cut) hairs. Also as with the FIG. 8C arrangement, the slots in the backing element for the left functional side of the element may be offset somewhat relative to the slots associated with the right operative half of the comb.

It will be appreciated that the teeth, whether on the base element or the backing element, constitute the guides to not only appropriately channel the hair for presentation to the blade cutting edges without significant "skipping" or missing of some of the hair and/or jamming or pulling of the hair, but also to generally guide the user as to the length of the cut. Appropriate selection of the tooth array, particularly the length of the teeth, will allow the sliding of the device through the hair at the desired depth relative to the scalp so as not to over cut. Essentially, therefore, the teeth can be utilized to define how far from the scalp the cut will be. This factor is perhaps most important for trimming of the back areas of the head, where the user may not have the availability of a mirror to see the actual cut, in a typical contemplated "do-it-yourself" situation.

It will be appreciated that the tooth set 107*b* of the FIG. 8B configuration and the upper left side tooth set of FIG. 9 are particularly shaped to provide a longer cut, say near the top of the head, aided by the longer teeth at the one end, and a shorter cut for around the ears, with a single pass of the device along the side of the head. The shortest version, which would normally be for the lower back of the head and neck and also the side burns, is the shortened set of teeth 7*a* in the FIG. 2A configuration, or using that base element with that set of teeth arranged along the backing element where the latter does not itself provide a set of teeth, i.e., anywhere along the top portion of the FIG. 8C back element or the upper right portion of the comb backing element of FIGS. 9.

In general operation, one can hold the device such that it makes a pass through the hair at close to perpendicular to the scalp, and then go to a more shallow angle, lifting up some hair like a barber does, then putting this lifted hair between the fingers of the other hand, also like a barber and cut it with the device, instead of a barber usually does with a scissors. In this operation, the device passes between the fingers and the scalp, and all the hairs are generally cut since they are effectively held on either side of the cutting edge. The fine teeth are generally effect for very fine or very little hair. Conversely, the larger teeth would help in case of thick, curly or course hair, e.g., a permanent wave.

It will also be appreciated that the base sets of teeth are generally on the course side to facilitate cutting of the hair. The combination of the coarse base teeth with a fine set of teeth on the back element will tend to act like "thinning scissors", since the tendency is to cut perhaps eighty percent of the hair passing by the sharp blade edges. Also, for the same purpose, the base teeth provided with alternate spacing could be used.

It will be further appreciated that the actual location of the slotted holes for receiving the turning end of the thumb screws, and the ribs and mating recesses is not critical so long as the mating relationship is effected, and the blades are aligned in the base recess, interposed in partially overlapping manner with the ribs projecting through the respective apertures of the blades.

Other embodiments and combinations of some or all of the various attributes, advantages and structural details of this invention become apparent from the foregoing description, and thus the invention shall not be limited to the specific embodiments and combinations illustrated herein. For example, one can provide in association with broad recess 11 of say FIG. 1 a perpendicular additional recess like item 21 of FIG. 8C. Similarly, one could combine the base element of say FIG. 2A with just the right side (or the left side, for that matter) portion of the comb/backing element of say FIG. 8C, in another convenient pocket or purse arrangement. In fact, the device could effectively provide both halves separated from one another for additional versatility. Versatility is additionally demonstrated through the ability of the user to associate any of the backing elements with any of the base elements 1, 100 etc.

There has been described herein a highly versatile, yet simple (both from assembly, i.e., blade replacement, and use standpoints) and inexpensive, hair trimming device which provides adjustability and a high degree of safety to accommodate the needs and taste of the individual user. The backing member may be a regular comb, modified only to the extent to allow passage of the thumb screw(s) and to accommodate the rib/recess relationship between the base and backing elements. In each embodiment, the device of the invention provides a tool, i.e. a comb or combing surfaces, which everyone can use with confidence and familiarity.

What is claimed is:

1. A hair trimming/cutting device employing at least one double-edge blade having an aperture, comprising:

an elongated base element defining a first longitudinal axis and a first facing surface of predetermined configuration;

a backing element at least a portion of which is elongated with respect to at least a portion of the base element, and defining a second longitudinal axis substantially coincident in direction with the longitudinal axis of the base element and a second facing surface of predetermined configuration intended for mating relationship with said first facing surface;

at least one of said base and backing elements providing at least one set of comb-like teeth of predetermined length and spacing, arranged relative to its longitudinal axis;

at least one of said base and backing elements providing a recess extending longitudinally for safely housing said at least one blade;

rotatably multi-orientational locking means adjustably coupled to one of said base and backing elements, for locking and unlocking the base and backing elements, said locking means structured to remain intact when said base and backing elements are disengaged;

at least one aperture of predetermined configuration extending through the other of said base and backing elements in substantial predetermined alignment relative to the aperture of said at least one blade, for receiving through said at least one blade at least a portion of said locking means when the latter is in a first orientation, and securing the base and backing elements together, with said at least one blade therebetween, when in a second orientation.

2. A device according to claim 1, wherein said locking means includes means rotatably achieving said first orientation for unlocking said base and backing elements and rotatably achieving said second orientation for securing the elements together, said first and second orientations being at a predetermined angle of rotation with respect to each other which is less than 180 degrees.

3. A device according to claim 2, wherein said locking means comprises an adjustable thumb screw/nut configuration.

4. A device according to claim 3, wherein said configuration is rotatable and spring loaded.

5. A device according to claim 4, wherein the nut is a cup nut having an annular recess to receive one end of a spring arranged on the shaft of the thumb screw.

6. A device according to claim 2, wherein said locking means is rotatably orientational in a plane perpendicular to the plane which includes the horizontal axes of said base and backing elements.

7. A device according to claim 1, wherein one of said facing surfaces has a plurality of ribs located to protrude through said aperture of said at least one blade when said blade is positioned in said recess, and the other said facing surface is provided with at least one recess to accommodate said ribs when said surfaces are in mating relationship.

8. A device according to claim 7, wherein said locking means comprises an adjustable thumb screw/nut configuration including a thumb screw portion, said configuration being arranged on said base element, and said backing element is provided with at least one elongated aperture to receive the thumb screw portion of the locking means when the latter is in said first orientation.

9. A device according to claim 7, wherein the backing element is a comb adapted to effect said mating relationship with said base element.

10. A device according to claim 1, wherein at least one of said base and backing elements provides a plurality of sets of said teeth.

11. A device according to claim 10, wherein both said base and backing elements provide at least one set of said teeth, each said set differing from the other in at least one of the parameters of tooth spacing, cross-section, and length.

12. A device according to claim 11, wherein the backing element is a comb adapted to effect said mating relationship with said base element.

13. A device according to claim 11, wherein said backing element provides at least two sets of teeth differing from one another and from said at least one set of teeth provided by the base element.

14. A device according to claim 13, wherein said backing element provides at least three differing sets of teeth.

15. A device according to claim 1, wherein said locking means remains coupled to said one of said base and backing elements when said elements are disengaged.

16. An improved hair trimming/cutting device employing a plurality of double-edge blades each having at least one aperture and sandwiched between a base element with at least a first set of teeth and a backing element having first and second sets of teeth which differ in tooth arrangement from each other and from the tooth arrangement of said base element first set of teeth, wherein the improvement comprises said backing element being reversably operatively arranged relative to the base element to provide a plurality of tooth set combinations each combination corresponding to a selectable hair trimming configuration, rotatably multi-orientational securing means arranged on one of said base and backing elements, and the other of said base and backing elements having means for receiving the multi-orientational securing means through said blades to secure the blades in a first orientation of said securing means, and for permitting the blades to be replaced and the selected hair trimming configuration provided by said corresponding base and backing element tooth set combination to be changed in a second orientation, said securing means remaining intact on said one of said base and backing elements in said first and second orientations.

17. A hair trimming/cutting device employing at least one double-edge blade having an aperture, comprising:

a base element defining a first longitudinal axis and having predetermined configuration which includes an elongated operating surface;

at least one backing element at least a portion of which is elongated with respect to at least a portion of the base element, said at least one backing element defining a longitudinal axis substantially coincident in direction with the longitudinal axis of the base element and having a predetermined configuration intended for mating operative relationship with said predetermined configuration of the base element, said predetermined configuration of said backing element including a pair of oppositely arranged elongated operating surfaces and said backing element being reversible with respect to said base element so that said operating surface of said base element can operatively mate with one of said operating surfaces of said backing element;

at least one of said base and backing elements providing at least one set of comb-like teeth of predetermined length and spacing, arranged relative to its longitudinal axis;

at least one of said base and backing elements providing a longitudinally extending recess in its said facing side for safely housing said at least one blade, an elongated gap being defined between the base and backing elements when the elements are in mating relationship proximate each cutting edge of said at least one blade; and rotatably multi-orientational locking means for locking and unlocking the base and backing elements, said locking means being adjustably coupled to one of said base and backing elements and structured to remain intact when said base and backing elements are disengaged.

18. A hair trimming device comprising:

a base element having a first axis and a first elongated surface for receiving a plurality of double-cutting-edged razor blades each having a longitudinally running slot, said blades being arranged to partially overlap one another along said first surface, said base element having a self-contained securing means for removably securing the razor blades thereto and at least one set of comb teeth arranged along at least one of the respective longitudinal edges of said base element, said teeth extending perpendicularly to and past the cutting edges of said razor blades, with a portion of said teeth enlarged and extending outward across said cutting edges of the blades to define a projection outward from the plane of said blades; and a plurality of ribs projecting outward from said first surface substantially equally spaced longitudinally on said first axis, at least one pair of said ribs protruding through the extremities of the slots of said blades and a second pair of said ribs protruding through said blade slots so as to be shared by all of said blades, said first surface having a plurality of perforations aligned with the slots of the end ones of said blades.

19. The device of claim 18, wherein said securing means comprises a pair of rotatable locking means each having a thumb screw with a flattened knob, a shank in two portions of pre-determined different diameter and a semi-spherical nut, said shank having the larger diameter portion proximate said knob and the smaller diameter proximate the opposite end for passing loosely through one of said perforations of said base element, said flattened knob in a first orientation passing loosely though the slot of said end blade associated with said one perforation, and wherein the smaller diameter portion of said shank includes an end having means for receiving said nut.

20. The device of claim 18, further including a backing element configured as an elongated comb and defining a second axis, said backing element having a longitudinally extending first surface of first and second portions, each intended for operative relationship with said first surface of the base element, and a longitudinally extending second surface also intended for operative relationship with said base element first surface; and a pair of elongated slots in said backing element associated with each of said first and second portions and located on said second axis, said elongated slots coinciding with a recessed groove embossed longitudinally in said first and second surfaces to receive the ribs of the first surface of said base element.

21. The device of claim 20, wherein the facing operative relationship of the base and backing elements defines a longitudinally running gap proximate the entirety of the cutting edges of said razor blades.

* * * * *